United States Patent [19]

Kohsaka

[11] Patent Number: 4,651,542

[45] Date of Patent: Mar. 24, 1987

[54] WASHING MACHINE

[75] Inventor: Yoshio Kohsaka, Aichi, Japan

[73] Assignee: Kabushiki Kaisha Toshiba, Kawasaki, Japan

[21] Appl. No.: 873,458

[22] Filed: Jun. 6, 1986

Related U.S. Application Data

[63] Continuation of Ser. No. 640,091, Aug. 13, 1984, abandoned.

[30] Foreign Application Priority Data

Aug. 17, 1983 [JP] Japan ..... 58-150696
May 25, 1984 [JP] Japan ..... 59-77450

[51] Int. Cl.[4] ..... D06F 23/04
[52] U.S. Cl. ..... 68/23 R; 68/174
[58] Field of Search ..... 68/23 R, 171–174, 68/38, 53, 89, 134, 148, 154

[56] References Cited

U.S. PATENT DOCUMENTS 1,211,129 1/1917 Franklin ..... 68/89
2,156,541 5/1939 Misenhimer et al. ..... 68/174 X
2,575,691 11/1951 Smith ..... 68/174 X
2,652,710 9/1953 DeRemer ..... 68/23.2
2,986,916 6/1961 Bochan ..... 68/23 R X
3,603,118 9/1971 Brucken et al. ..... 68/23 R X
3,641,791 2/1972 Wine et al. ..... 68/134 X
4,252,005 2/1981 Stokes ..... 68/172

FOREIGN PATENT DOCUMENTS 36-13469 5/1961 Japan .
51-56580 5/1976 Japan .
55-25878 2/1980 Japan .

*Primary Examiner*—Philip R. Coe
*Attorney, Agent, or Firm*—Cushman, Darby & Cushman

[57] ABSTRACT

A washing machine includes a washing tub whose peripheral wall is formed of an upper peripheral wall section and a lower peripheral wall section located thereunder and adapted to be rotated in two opposite directions. The washing tub receives laundry and water therein. In the washing mode, the lower peripheral wall section is rotated both clockwise and counterclockwise. Thus, the laundry is circulated by frictional contact with the lower peripheral wall section and is washed by the effect of multiplication of frictional forces produced by contact with the upper and lower peripheral wall sections. A projection protrudes upward from the inner bottom surface of the washing tub and is located inside the lower peripheral wall section to touch the laundry to increase the cleaning efficiency.

23 Claims, 8 Drawing Figures

WASHING MACHINE

This is a continuation of application Ser. No. 640,091, filed Aug. 13, 1984, which was abandoned upon the filing hereof.

BACKGROUND OF THE INVENTION

The present invention relates to a washing machine comprising a washing tub including an upper peripheral wall section which is stationary in a washing mode and a lower peripheral wall section which is rotated clockwise and counterclockwise in the washing mode. More particularly, this invention relates to a washing machine in which laundry is put together with water in the washing tub, and, in the case of a small amount of laundry, the laundry is circulated and washed mainly by a water flow produced by the rotation of the lower peripheral wall section, and, in the case of a large amount of laundry, the laundry is washed by friction with the upper peripheral wall section and its own circulation caused by a frictional force attributed to its contact with the lower peripheral wall section.

In a prior art washing machine of a pulsator type in which the water flow is produced by a pulsator which has vanes or blades projecting therefrom and, the laundry is washed as it follows the cycling water. In the washing machine of this type, therefore, the washing tub requires a capacity large enough to accommodate a specified load size. Thus, only a limited amount of laundry can be washed at a time. If the laundry to be cleaned is too small, the flow of water becomes so intense that the laundry will be excessively washed. If there is too much laundry, on the other hand, the water flow slows down correspondingly, thus lowering the washing efficiency. In the washing machine of this type, moreover, the laundry touches the pulsator only accidentally and partially. It is therefore impossible to produce a satisfactory rub- or friction-washing effect for the entire load. Thus, the washing action of the washing machine of this type is uneven and is liable to damage the laundry.

Meanwhile, a washing machine without a pulsator has recently been proposed in which a washing tub containing water and laundry therein is intermittently rotated as a whole, deriving a washing effect from the difference in circulating speed between the water and laundry. Although the washing machine of this type is not liable to damage the laundry, the washing efficiency is low because of the simple motion of the laundry therein, which is attributed to the small difference between the circulating speeds of the water and laundry.

SUMMARY OF THE INVENTION

The present invention is contrived in consideration of these circumstances and is intended to provide a washing machine enjoying a greater and uniform washing effect without using a pulsator or without rotating the whole structure of a washing tub, and is intended to eliminate the possibility of damaging laundry, thereby permitting a larger amount of laundry to be washed at a time and widening the range of the amount of laundry for a moderate washing effect.

According to one aspect of the present invention, there is provided a washing machine comprising a washing tub whose peripheral wall is formed of an upper peripheral wall section and a lower peripheral wall section located thereunder and adapted to be rotated in two opposite directions. In this washing machine, laundry, along with water, is put into the washing tub, and the lower peripheral wall section is rotated both clockwise and counterclockwise. Thus, the laundry is circulated by frictional contact with the lower peripheral wall section and is washed by the effect of multiplication of frictional forces produced by contact with the upper and lower peripheral wall sections. Also, a projection protrudes upward from the inner bottom surface of the washing tub.

By constructing the present invention as one aspect of the above, the laundry can be washed by both washing-by-rubbing effect which is produced by the friction between the two peripheral wall sections and between the laundry itself, and washing-by-massage effect which is produced as a result of the laundry receiving forces acting in different directions from both the upper and lower peripheral wall sections. Moreover, the projection may positively wash that portion of the laundry near the center of the washing tub which less frequently comes into contact with the upper and lower peripheral wall sections. Therefore, even extremely soiled clothes can be washed evenly and effectively.

According to another aspect of the invention, the projection is removably attached to the inner bottom portion of the washing tub.

With this arrangement, the projection may be removed from the washing tub to increase its capacity in the case where a large amount of slightly soiled laundry is to be washed.

BRIEF DESCRIPTION OF THE DRAWINGS

FIGS. 1 to 3 show a washing machine according to one embodiment of the present invention, in which FIG. 1 is a vertical sectional view of the washing machine, FIG. 2 is a sectional view taken along line II—II of FIG. 1, and FIG. 3 is a side view of a water-level switch;

DETAILED DESCRIPTION OF THE PREFERRED EMBODIMENT

A washing machine with a dehydrating function according to one embodiment of the present invention will now be described in detail with reference to the accompanying drawings.

Figure 1:
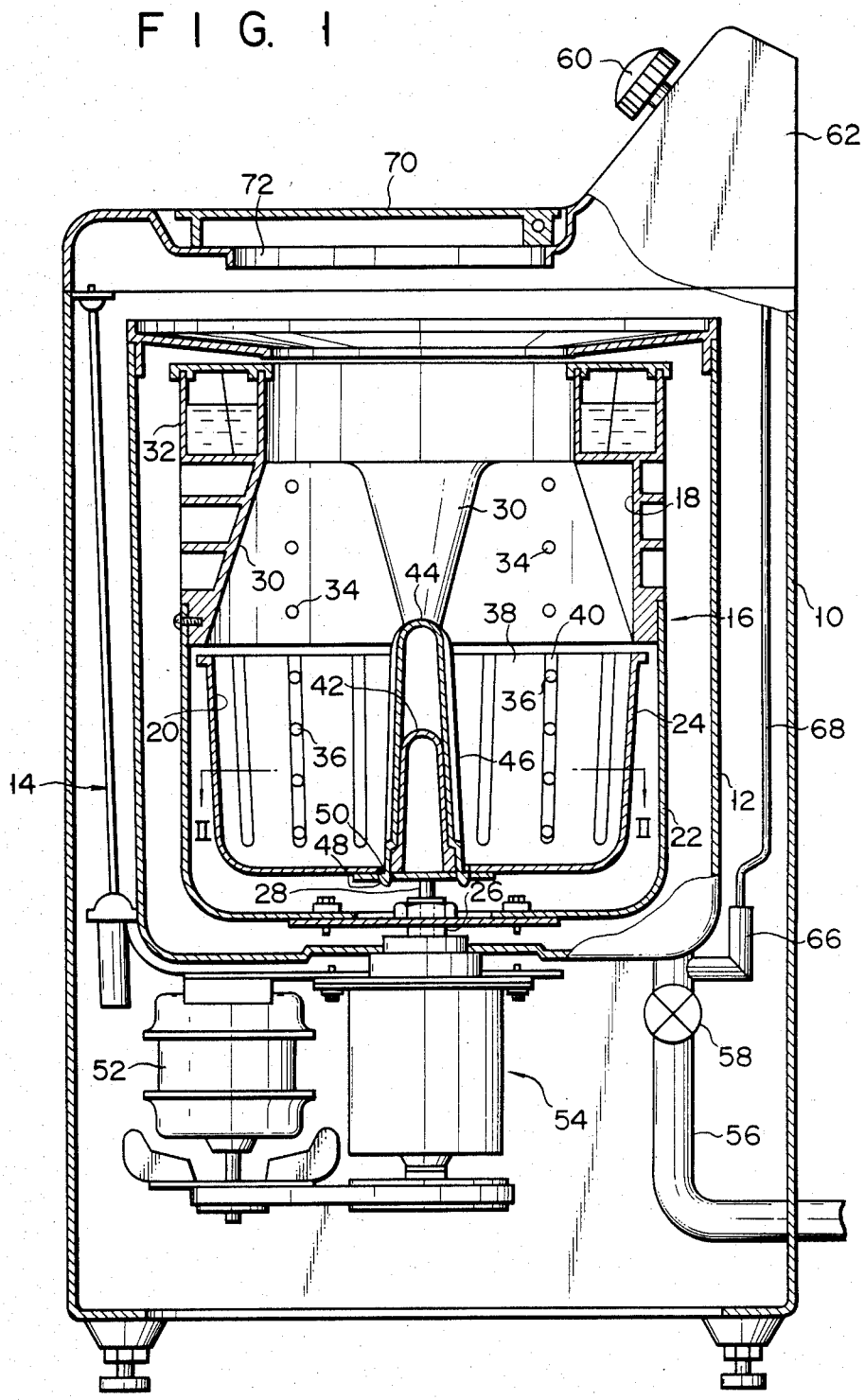

In FIG. 1, reference numeral 10 denotes an outer casing of the washing machine. Inside the casing, a water-receiving tub 12 is elastically supported by a suspension rod mechanism 14 so that it may be swingable relative to the outer casing 10. A cylindrical washing tub 16 is rotatably disposed in the water-receiving tub 12. The peripheral wall of the washing tub 16 is formed of an upper peripheral wall section 18 and a lower peripheral wall section 20 located thereunder. In other words, the washing tub 16 is composed of a first tub 22 and a shallow vessel-shaped stirring member or second tub 24 housed in the lower poriton of the first tub 22. The tub 22 rotates only during the dehydrating operation. In the dehydrating mode, the stirring member 24 rotates together with the tub 22. In the washing mode, on the other hand, the stirring member 24 is rotated in both the clockwise and counterclockwise directions. The upper peripheral wall section 18 is substantially composed of the upper half of the tub 22, while the lower peripheral wall section 20 is formed of the peripheral wall of the stirring member 24.

The washing tub 16 will now be described in detail. The tub 22 is rotatably disposed in the water-receiving tub 12. A hollow dehydrating shaft 26 is connected to the central portion of the bottom wall of the tub 22. The stirring member 24 is fitted in the inner peripheral wall of the tub 22 so as to be coaxial therewith. The central portion of the bottom wall of the stirring member 24 is connected to a washing shaft 28, which extends through the hollow dehydrating shaft 26. The upper end of the washing shaft 28 protrudes upward from the inner bottom surface of the tub 22 and is attached to the undersurface of the stirring member 24.

The height of the lower peripheral wall section 20 of the stirring member 24 is substantially half that of the tub 22. The diameter of the stirring member 24 is set within the range for rotation inside the tub 22. The inner and outer peripheral surfaces of the stirring member 24 are tapered such that they become gradually larger in diameter from the lower portion toward the upper portion.

A plurality of projections 30 protrude from the inner peripheral surface of the upper peripheral wall section 18 of the tub 22. Each projection 30 vertically extends from the upper end portion of the stirring member 24 to the upper end of the tub 22 and is inclined toward the axis of the tub 22 from its lower end to its upper end. In this embodiment, the washing tub 16 doubles as a dehydrating tub. Accordingly, a ring-shaped balancer 32 with a liquid sealed therein is coaxially attached to the top of the tub 22. A number of dehydrating holes 34 and 36 are formed in the upper peripheral wall section 18 of the tub 22 and the lower peripheral wall section 20 of the stirring member 24, respectively. In this case, a plurality of vertically extending ridges 38 and grooves 40 are alternately formed on the inner surface of the peripheral wall of the stirring member 24. The dehydrating holes 36 are formed in the grooves 40 for higher efficiency of water removal from the laundry at the time of dehydration.

Figure 2:
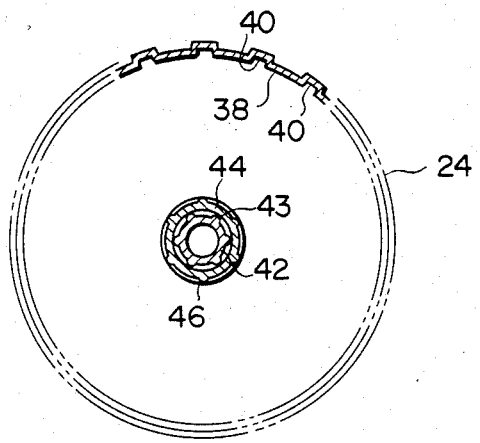

A small friction projection (second projection) 42 protrudes vertically upward from the center of the inner bottom portion of the stirring member 24. The projection 42 is in the form of a relatively slender, short tapered rod. The length of the projection 42 is substantially half the height of the lower peripheral wall section 20. As shown in FIG. 2, a plurality of vertically extending ridges 43 are formed on the outer peripheral surface of the projection 42 to increase the friction force with the laundry. Further, a hollow friction projection (first projection) 44 is removably attached to the center of the inner bottom portion of the stirring member 24, extending vertically upward. The projection 44 is in the form of a tapered rod of a substantially curvilinear shape, whose length is a little greater than the depth of the stirring member 24 and whose inside diameter is substantially equal to the outside diameter of the small friction projection 42. This projection 44 does not have any rectilinear projections (such as vanes) extending therefrom. As shown in FIG. 2, a plurality of ridges 46 similar to the ridges 43 are formed on the outer peripheral surface of the projection 44, and a plurality of elastic engaging claws 48 protrude integrally from the lower end portion of the projection 44. The friction projection 44 is fitted on the small friction projection 42 so that the elastic engaging claws 48 elastically engage small holes 50 formed in the bottom wall of the stirring member 24. Thus, the friction projection 44 is removably set up in the stirring member 24.

The washing shaft 28 and the dehydrating shaft 26 are connected to a washing machine motor 52 as a drive source through a power control mechanism 54 disposed below the water-receiving tub 12. The power control mechanism 54 transmits, in the washing mode, the rotatory force of the washing machine motor 52 to the washing shaft 28 in a manner such that the motor speed is reduced and the rotating direction of the motor 52 is alternately reversed. In the dehydrating mode, the rotational force is transmitted to the dehydrating shaft 26 and the washing shaft 28, thereby rotating the tub 22 together with the stirring member 24. To attain this, the power control mechanism 54 contains therein a speed reduction mechanism, clutch mechanism, braking mechanism, etc. In the washing mode, according to such an arrangement, the tub 22 is restrained from rotating by the braking mechanism so that only the stirring member 24 is rotated in both directions. Accordingly, that portion of the peripheral wall of the tub 22 which is exposed above the peripheral wall of the stirring member 24 serves as a fixed peripheral wall portion or the upper peripheral wall section 18 of the washing tub 16. On the other hand, the peripheral wall of the stirring member 24 functions as a movable peripheral wall portion or the lower peripheral wall section 20.

Figure 3:
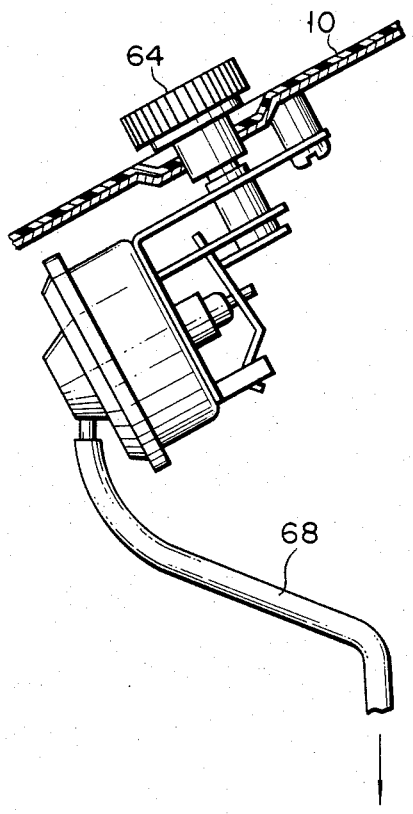

A drainage hose 56 is connected to the bottom portion of the water-receiving tub 12. A drainage valve 58 is mounted midway on the drainage hose 56. The drainage valve 58 controls the drainage from the water-receiving tub 12 and the washing tub 16 through the drainage hose 56 to the outside of the machine. A timer device 60 is disposed in an operation box 62 on the outer casing 10, whereby various aspects of washing and dehydrating cycles are controlled. As shown in FIG. 3, a water-level switch 64 is arranged side by side with the timer device 60 on the operation box 62. The water-level switch 64 serves to optionally set the level of the water introduced into the water-receiving tub 12. An air trap 66 is connected at one end to the water level switch 64 by means of a tube 68 and at the other end to that portion of the drainage hose 56 between the drainage valve 58 and the water-receiving tub 12. The air trap 66 senses the pressure of the water received in the water-receiving tub 12. The water level switch 64 controls, in accordance with the water level sensed by the air trap 66, the timing for the end of the water feed into the water-receiving tub 12. In FIG. 1, reference numeral 70 denotes a cover to open and close a laundry inlet/outlet opening 72 at the top of the outer casing 10.

The operation of the washing machine having the above-mentioned construction will now be described. At the start of a washing cycle, substantially the same amount of water for a conventional pulsator-type washing machine is poured into the water-receiving tub 12 and hence the washing tub 16. The laundry is then thrown into the washing tub 16. Thus, the washing operation is performed by only rotating the stirring member 24 clockwise and counterclockwise while the tub 22 is kept from rotating by the braking mechanism. In this embodiment, the rotational frequency of the stirring member 24 ranges from 120 to 180 rpm, and the rotating direction is reversed with every two or three revolutions.

In the washing operation performed in this manner, the laundry is brought into contact with both the peripheral wall 20 of the stirring member 24 and the upper half portion of the peripheral wall of the tub 22. In the lower portion of the washing tub 16, therefore, the laundry is subjected to a rotational force from the stirring member 24 when it is brought into frictional contact with the stirring member 24. In the upper portion of the washing tub 16, on the other hand, the laundry is subjected to a binding force when it is brought into frictional contact with the tub 22. Owing to the frictional forces acting in different directions as mentioned, the laundry undergoes a twisting or pressing action. This action is repeatedly applied to the laundry through the reverse rotation of the stirring member 24.

Further, since the laundry is pushed toward the peripheral wall of the stirring member 24 by a centrifugal force resulting from the rotation of the stirring member 24, a counteraction or centripetal force acts inward from the upper peripheral wall of the tub 22. As a result, streams of water vertically revolving in the two opposite directions are produced, causing the laundry to move in a complicated manner. Thereupon, the laundry, subjected to the rotational force from the stirring member 24, moves circumferentially in frictional contact with the peripheral wall 18 of the tub 22. When the laundry meets the projection 30, they strongly rub against each other. Thus, the laundry is drawn downward by the multiplication effect of the resisting force of the projection 30 and the rotational force of the stirring member 24. Further, the laundry is driven toward the center of the washing tub 16 when it is urged to get over the projection 30. Thus, the existence of the projection 30 complicates the motion of the laundry, accelerating the vertical and radial shifting of the laundry.

Since the stirring member 24 is tapered downward, the motion of the laundry urged by the centrifugal force is smooth, and the water can move smoothly. Thus, both the laundry and the water can rise up more easily.

In this embodiment, moreover, the ridges 38 are formed on the inner peripheral surface of the stirring member 24, so that the laundry undergoes a stronger rub-washing action and a greater rotational force. Thus, the laundry in the tub 22 may enjoy a massage-like action as well as the rub-washing action.

As mentioned before, the existence of the projection 30 accelerates the vertical and radial shifting of the laundry. However, if the amount of the laundry is large, only a small part of the laundry tends to move from the central portion of the washing tub 16 to the peripheral portion despite the action of the projection 30. Therefore, chances for the laundry located at the central portion of the washing tub 16 to come into contact with the respective peripheral walls 18 and 20 of the tub 22 and the stirring member 24 are decreased, lowering the washing efficiency. According to this embodiment, however, the friction projection 44 is set up in the central portion of the stirring member 24, so that the laundry located in the central portion of the washing tub 16 touches the friction tub 44 to be rubbed and washed by its own circulation or the rotation of the friction projection 44. Thus, the laundry near the center of the washing tub 16 can be washed evenly, enjoying improved cleaning efficiency. Fitted on the small friction projection 42, the friction projection 44 is reinforced and prevented from tilting by the small friction projection 42.

Detachably mounted, moreover, the friction projection 44 can be removed so that only slightly soiled laundry is softly rubbed by the small friction projection 42. Thus, the two projections 44 and 42 can be used selectively according to the degree of soiling of the laundry.

Furthermore, the removal of the relatively large-sized friction projection 44 leads to an increase in the substantial capacity of the washing tub 16, allowing a greater amount of slightly soiled laundry to be handled at a time.

Figure 4:
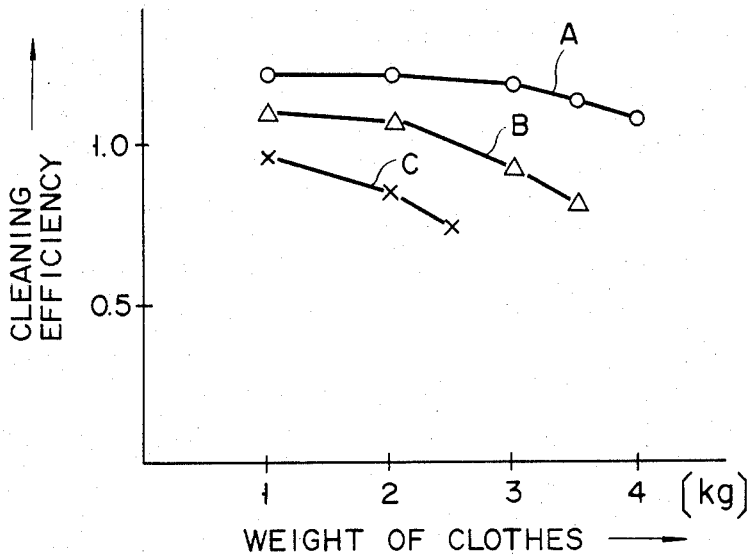
FIG. 4 shows characteristic curves indicating the relationship between the cleaning efficiency of the washing machine of the invention and the amount of laundry as a load, as compared with the case of a prior art washing machine.

As described above, the laundry is subjected to washing-by-rubbing effect produced by great friction with other laundry in the tub, and with the peripheral walls of the tub 22 and the stirring member 24 and with the friction member 44, as well as to washing-by-massage effect attributed to repetition of twisting or compression. The improved washing or cleaning efficiency of the washing machine according to the present invention will be apparent from the characteristic curves shown in FIG. 4 as one example of the results of comparison. In FIG. 4, a curve A indicates the cleaning efficiency which is attained by the embodiment of the invention. A curve B indicates the cleaning efficiency attained by a prior art washing machine of a pulsator type, and a curve C indicates the cleaning efficiency attained by a washing machine using only washing-tub rotation which was conceived prior to the present invention. As seen from FIG. 4, the cleaning efficiency attained by the invention is higher than that for other methods. Here it is to be noted that the cleaning efficiency is regulated by JIS (Japanese Industrial Standard) C 9606.

In this embodiment, as stated above, the laundry is moved by its frictional contact with the respective peripheral walls of the tub 22 and the stirring member 24. Hereupon, if the amount of laundry increases, the magnitude of the frictional force involved will increase in proportion. Accordingly, the increase of the load will never retard the movement of the laundry. Thus, even if a greater amount of laundry is fed to the machine, the washing efficiency will hardly be lowered. If the amount of laundry or load is small, on the other hand, the laundry will less frequently come into contact with the peripheral wall of the stirring member 24, so that the frictional force resulting from such contact will be smaller. The laundry is circulated and washed by water streams produced mainly by the rotation of the stirring member 24. However, any amount of laundry can be washed to a proper degree, protected against excessively strong water streams which would be produced in the conventional pulsator-type washing machine. Thus, in the washing machine of the present invention, the range of the amount of laundry for proper washing effect is wider than in the prior art washing machine.

Further, if the amount of laundry is relatively small, the laundry is circulated by water streams produced mainly by the lower peripheral wall section. As the laundry is increased in quantity, it comes into contact with both the upper and lower peripheral wall sections to be moved by the multiplication effect of their respective frictional forces. Accordingly, any amount of laundry can be subjected to the necessary motion for washing.

Thus, much more laundry than in the prior art washing machine can be washed at one time with use of a washing tub of a fixed capacity. Moreover, the cleaning efficiency can be increased without damaging the laundry, and the range of the amount of laundry for the proper washing effect is widened. Thus, an excessive or insufficient washing effect attributed to variations in the amount of laundry can be avoided.

In the above-mentioned washing machine, furthermore, the dehydrating operation is performed as follows. First, the water in the water-receiving tub 12 is discharged by operating the drainage valve 58. Then, the braking mechanism is released to unlock the tub 22, and the vessel-shaped stirring member 24 and the tub 22 are rotated together in one direction.

It is to be understood that the present invention is not limited to the above-mentioned embodiment, and that various changes and modifications may be effected therein by one skilled in the art without departing from the scope or spirit of the invention. Several modifications will now be described.

Although the present invention, according to the above embodiment, has been described as being applied to a washing machine with a dehydrating function, it may also be applied to one without the dehydrating function. In this case, the water-receiving tub is omitted, and the tub 22 has no holes in its peripheral wall so that it can contain water unaided. It is to be understood that the arrangement of the peripheral wall of the washing tub, which consists of the upper and lower peripheral wall sections, is not limited to the combination of the first tub 22 and the stirring member 24 having the aforementioned specific configuration.

Figure 5:
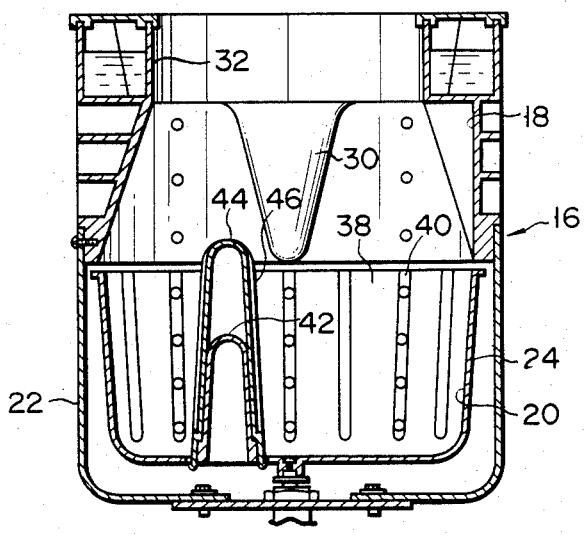
FIGS. 5 to 8 are sectional views corresponding to FIG. 2 showing varied modifications of a projection or projections used in the above embodiment.

In the above embodiment, moreover, the small friction projection 42 and the friction projection 44 are provided in the center of the inner bottom portion of the vessel-shaped stirring member 24. Alternatively, however, they may be arranged as shown in FIG. 5. The modification shown in FIG. 5 differs from the above embodiment in that the small friction projection 42 and the friction projection 44 protruding from the inner bottom portion of the stirring member 24 are located eccentrically to the central axis of the stirring member 24. With this arrangement, the laundry located in the central portion of the washing tub 16 can be stirred by the small friction projection 42 or the friction projection 44, possibly enjoying the jostle-washing effect. Thus, the cleaning efficiency is further improved.

Figure 6:
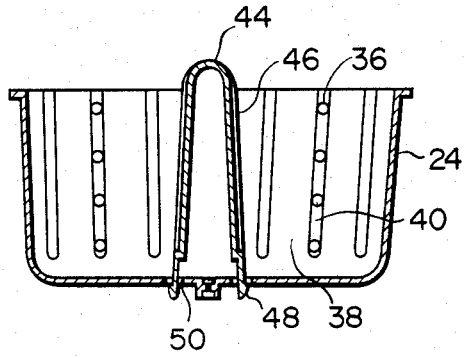
Figure 7:
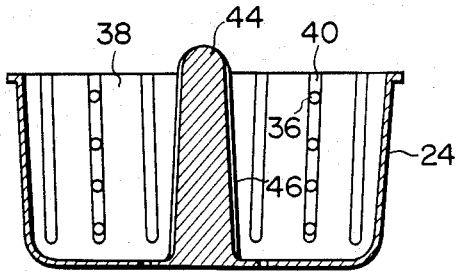

Although the small friction projection 42 is formed integrally on the stirring member 24 in the above embodiment, it may be independently formed and fixedly or removably attached to the stirring member 24. FIG. 6 shows another modification, in which only the friction projection 44 is removably attached to the stirring member 24 without using the small friction projection. Alternatively, a plurality of removable friction projections of different lengths may be provided so that they are replaced with one another according to the degree the laundry being handled is soiled. As shown in FIG. 7, moreover, the friction projection 44 may be formed integrally with the vessel-shaped stirring member 24.

Figure 8:
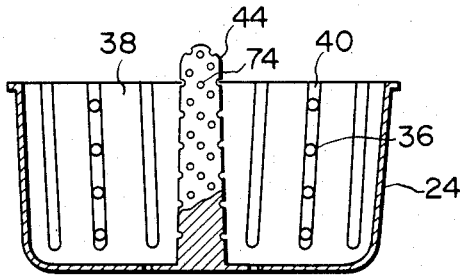

In the above-mentioned embodiment, furthermore, the vertically extending ridges 46 are formed on the outer peripheral surface of the friction projection 44. As shown in FIG. 8, however, a number of recesses 74 for increasing the frictional force may be formed in the outer peripheral surface of the friction projection 44. The cross-sectional shape of each projection is not limited to the circular configuration. For example, the projection may have an elliptic or square cross section.

What is claimed is:

1. A washing machine comprising:

an outer casing having an opening at an upper end thereof;

a cylindrical washing tub coaxially arranged in the outer casing having a bottom which is closed to provide a tub capable of holding laundry, and an open top to allow laundry to be deposited therein, said tub being rotatable around a vertical axis thereof and including a first peripheral wall section, and a second peripheral wall section disposed below and rotatable independently of the first peripheral wall section;

a main projection in the form of a hollow cylinder extending upward from an inner portion of the bottom of and removably attached to the washing tub, and adapted to contact the laundry in the washing tub to increase the cleaning efficiency of the washing machine, wherein said projection is formed without vanes or blades extending therefrom; and driving means for selectively rotating the first peripherial wall section and the second peripheral wall section and main projection.

2. The washing machine according to claim 1, wherein said washing tub has a subsidiary projection protruding upward from the inner bottom portion thereof, located inside the second peripheral wall section, and adapted to contact the laundry for a cleaning effect, said subsidiary projection being shorter and thinner than the main projection, and said main projection being arranged to enclose the subsidiary projection.

3. The washing machine according to claim 2, wherein said subsidiary projection has on its outer surface a plurality of ridges for increasing the friction between the subsidiary projection and the laundry.

4. A washing machine comprising:

an outer casing having an opening in an upper end thereof;

a cylindrical washing tube having an inner bottom portion and an open top portion to allow laundry to be placed therein, said tub being coaxially arranged in the outer casing and rotatable around a vertical axis thereof, said washing tub including a first peripheral wall section, a second peripheral wall section disposed under and rotatable independently of the first peripheral wall section, and a main projection protruding upward from the inner bottom portion of and removably attached to the washing tub, said projection being in the form of a vertically extending rod which is formed without vanes or blades thereupon, and which is spaced from said first and second peripheral wall sections, the inner surfaces of said first and second peripheral wall sections and the outer surface of said main projection being formed to have a high resistance such that they are brought into frictional contact with the laundry when the second peripheral wall section is rotated; and driving means for rotating the second peripheral wall section in a washing mode while maintaining the first peripheral wall section stationary.

5. The washing machine according to claim 4, wherein said main projection extends from the inner bottom surface of the washing tub with and terminates near the level of the upper edge of the second peripheral wall section.

6. The washing machine according to claim 5, wherein said main projection extends from the inner bottom surface of the washing tub to beyond the level of the upper end of the second peripheral wall section.

7. The washing machine according to claim 4, wherein said main projection has an outer peripheral surface which tapers toward an upper portion thereof so that a lower portion thereof has a cross-section which defines a larger area than a cross-section of said upper portion.

8. The washing machine according to claim 7, wherein said main projection has a plurality of ridges on the outer peripheral surface for increasing the friction between the main projection and the laundry.

9. The washing machine according to claim 7, wherein said main projection has a plurality of recesses in the outer peripheral surface for increasing the friction between the main projection and the laundry.

10. The washing machine according to claim 4, wherein said main projection is coaxial with the second peripheral wall section.

11. The washing machine according to claim 4, wherein said main projection is eccentric to the central axis of the second peripheral wall section.

12. The washing machine according to claim 4, wherein said main projection is in the form of a hollow cylinder.

13. The washing machine according to claim 4, wherein said washing tub includes a first bottomed tub housed in the outer casing and a second bottomed tub housed in the lower portion of the first tub, said first peripheral wall section being formed of that peripheral wall portion of the first bottomed tub which is located above the second bottomed tub, and said second peripheral wall section being formed of the peripheral wall of the second bottomed tub.

14. The washing machine according to claim 13, wherein said main projection is provided on the inner bottom surface of the second bottomed tub.

15. The washing machine according to claim 14, wherein said second peripheral wall section has an inner peripheral surface formed such that its diameter gradually increases from its lower portion toward its upper portion.

16. The washing machine according to claim 13, wherein said first peripheral wall section has a plurality of vertically extending projections on the inner peripheral surface thereof, whereby the friction between the first peripheral wall section and the laundry is increased.

17. The washing machine according to claim 16, wherein each of said projections extends from the bottom to top of the first peripheral wall section and is inclined toward the axis of the first peripheral wall section from the lower end to the upper end thereof.

18. The washing machine according to claim 13, wherein said driving means includes a washing shaft for rotating the second bottomed tub in two opposite directions in a washing mode, said washing shaft extending through the bottom portion of the first bottomed tub and fixed to the outer bottom portion of the second bottomed tub.

19. The washing machine according to claim 18, which further comprises a water-receiving tub disposed in the outer casing, and wherein said first bottomed tub is rotatably disposed in the water-receiving tub and has a number of through holes in the peripheral wall thereof, and said driving means includes a dehydrating shaft penetrating the bottom portion of the water-receiving tub to be fixed to the bottom of the first bottomed tub and adapted to keep the first bottomed tub stationary in the washing mode and to rotate the first bottomed tub together with the second bottomed tub in a dehydrating mode.

20. A washing machine comprising:

an outer casing having an opening in an upper end thereof;

a cylindrical washing tub having a closed bottom portion and an open top portion, said tub being arranged in the outer casing and rotatable around a vertical axis thereof, said washing tub including a first peripheral wall section, and a second peripheral wall section disposed below and rotatable independently of the first peripheral wall section;

a first projection protruding upward from an inner portion of the bottom portion of the washing tub, in a direction substantially parallel to said vertical axis, said first projection being in the form of a vertically extending rod spaced from said first and second peripheral wall sections and tapering from a lower section thereof to an upper section so that an area defined by the lower section thereof is larger than an area defined by the upper section, said first projection adapted to contact the lanudry to increase the cleaning efficiency of the washing machine;

a second, hollow projection with an inside surface substantially equal in dimensions to an outer surface of said first projection, so that said second projection is coaxially insertable around said first projection, thereby allowing said washing machine to be selectively operable with either of said two projections, wherein said second projection has an outer surface of a generally curvilinear shape which has no vanes or blades or other projections extending therefrom in any plane perpendicular to a plane which includes said vertical axis, said second projection tapering from a lower portion toward an upper portion so that a cross-section of said lower portion defines more area than a cross-section of said upper portion; and driving means for rotating the second peripheral wall section in a washing mode while maintaining the first peripheral wall section stationary.

21. A machine as in claim 20 wherein the outer surfaces of both of said projections have ridges thereupon.

22. A machine as in claim 4 wherein the outer surface of said main projection is substantially curvilinear.

23. The washing machine according to claim 4, wherein said washing tub has a subsidiary projection protruding upward from the inner bottom portion thereof, located inside the second peripheral wall section, and adapted to touch the laundry for a cleaning effect, said subsidiary projection being shorter and thinner than the main projection, and said main projection being arranged to enclose the subsidiary projection.

* * * * *